US007785213B2

(12) United States Patent
Matsunaga et al.

(10) Patent No.: US 7,785,213 B2
(45) Date of Patent: Aug. 31, 2010

(54) GOLF CLUB HEAD

(75) Inventors: Hideo Matsunaga, Saitama-ken (JP); Makoto Kubota, Tokyo (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 2 days.

(21) Appl. No.: 11/871,035

(22) Filed: Oct. 11, 2007

(65) Prior Publication Data

US 2008/0090675 A1 Apr. 17, 2008

(30) Foreign Application Priority Data

Oct. 17, 2006 (JP) ..... 2006-282973
Jul. 3, 2007 (JP) ..... 2007-174848

(51) Int. Cl.
*A63B 53/04* (2006.01)

(52) U.S. Cl. ..... 473/342; 473/345

(58) Field of Classification Search ..... 473/342, 473/345, 350

See application file for complete search history.

(56) References Cited

U.S. PATENT DOCUMENTS 5,697,855 A * 12/1997 Aizawa ..... 473/350
5,873,793 A * 2/1999 Swinford ..... 473/317
5,941,782 A 8/1999 Cook
6,595,871 B2 7/2003 Sano
6,800,039 B1 * 10/2004 Tseng ..... 473/329
6,949,031 B2 * 9/2005 Imamoto et al. ..... 473/329
6,989,506 B2 * 1/2006 Yabu ..... 219/121.64

(Continued)

FOREIGN PATENT DOCUMENTS

JP 09-192273 A 7/1997

(Continued)

OTHER PUBLICATIONS

United Kingdom Search Report dated Jan. 30, 2008.

*Primary Examiner*—Stephen L. Blau
(74) *Attorney, Agent, or Firm*—Sughrue Mion, PLLC

(57) ABSTRACT

A golf club head includes a metallic head body 1 having a cavity 10 therein and an opening 8 being formed in a face part 2 therethrough to the cavity, and a metallic face plate 9 welded to the opening. The opening 8 is demarcated by an upper edge along an upper end of the face part 2 and a U shaped curved edge (8B, 8A, 8C) located within the face part 2, and is also formed so that, in a state in which the head body 1 is soled in accordance with the lie angle, a projection line A on the face part surface of the perpendicular passing through the lowermost portion X of the opening 8 coincides with a projection line A on the face part surface of the perpendicular passing through a ground contact point Y of a sole part 4, or the projection line drawn with the lowermost portion X of the opening 8 being the reference is positioned close to a heel part 7 with respect to the projection line A drawn with the ground contact point Y of the sole part; and the ratio of width $W_2$ on the toe side with respect to the projection line drawn with the ground contact point Y of the sole part 4 is higher than the ratio of width $W_1$ on the heel side toward a crown part. The face plate 9 is formed so as to have a shape matching the opening 8.

2 Claims, 5 Drawing Sheets

U.S. PATENT DOCUMENTS

| | | | | |
|---|---|---|---|---|
| 7,086,963 | B1 * | 8/2006 | Onuki et al. | 473/342 |
| 7,469,108 | B2 * | 12/2008 | Kawasaki et al. | 399/45 |
| 7,575,525 | B2 * | 8/2009 | Matsunaga et al. | 473/342 |
| 2005/0101406 | A1 | 5/2005 | Hirano | |
| 2006/0094531 | A1 * | 5/2006 | Bissonnette et al. | 473/329 |

FOREIGN PATENT DOCUMENTS

| | | | |
|---|---|---|---|
| JP | 2001-87428 | A | 4/2001 |
| JP | 2001-137397 | A | 5/2001 |
| JP | 2001-246027 | A | 9/2001 |
| JP | 2003-33450 | A | 2/2003 |
| JP | 2003-265656 | A | 9/2003 |
| JP | 2004-65853 | A | 3/2004 |
| JP | 2004-222792 | A | 8/2004 |
| JP | 2006-166975 | A | 6/2006 |
| WO | 03/004108 | A1 | 1/2003 |

* cited by examiner

GOLF CLUB HEAD

FIELD OF THE INVENTION

The present invention relates to a metallic hollow golf club head and, more particularly, to a golf club head in which a face plate is welded to an opening formed in a face part.

BACKGROUND OF THE INVENTION

As a conventional metallic hollow golf club head in which a face plate is welded, a golf club head shown in FIG. 8 has been known. In this golf club head, a substantially rectangular opening 20 is formed in a face part 2 of a metallic head body 1 having a cavity 10 therein, and a face plate 30 having a shape matching the opening 20 is laser welded to a receiving part 2*b* formed at the periphery of the opening 20. The head body 1 includes a crown part 3, a sole part 4, and a hosel 5 in addition to the face part 2, and has a toe 6 and a heel 7. In this conventional example, the welding strength is improved, and therefore damage is less liable to occur (refer to JP 2004-65853 A1).

Also, as a golf club head in which the whole of the face part is a member separate from the head body and this face part is welded to the head body, there has been known a golf club head in which the face part is deflected when the ball is hit by decreasing the thickness of the face part, thereby increasing carry. By being influenced by the shape of the head body, such a face part is formed so that the length in the right and left direction (the toe-heel direction) is greater than the length in the up and down direction (the top-sole direction). Therefore, the defection of the face part when the ball is hit is longer in the right and left direction than in the up and down direction, and the slope toward the center position at which the deflection is greatest is gentler in the right and left direction than in the up and down direction of face. For this reason, the ball is not compressed by a shock when the ball is hit while the ball cross section perpendicular to the hit direction (the ball compressing direction) is maintained in a circular shape. Uneven compression causes distortion of the circular cross-sectional shape, which makes it difficult to control the direction that the ball flies.

As a golf club head for solving the above problem, there has been known a golf club head in which an opening having almost the same lengths in the up and down direction and the right and left direction is formed in the face part, and a face plate having the same shape as that of the opening is welded to the opening, by which the occurrence of anisotropy is prevented, and the rebounding force at the hit time is increased by compressing a ball into a uniform shape (refer to JP 2003-265656 A1).

BRIEF SUMMARY OF THE INVENTION

The above-described conventional face plate has been developed assuming that a golfer hits the ball at the center of the face plate or the periphery thereof, that is, the sweet spot. The conventional face plate does not sufficiently accommodate variations in hit points of general amateur golfers. JP 2003-265656 A1 has been made from the viewpoints described below. The material of the head is changed from stainless steel to titanium alloy in response to the recent tendency for the head size to increase. Also, paying attention to the fact that titanium alloy has a high strength in comparison with its low Young's modulus, which is about 60% of that of stainless steel, the thickness of the face surface is decreased to deflect the face surface at the hit time, by which the initial velocity (delivery velocity) of ball is increased. However, when a ball is hit at a portion deviating from the sweet spot, and further at the face part such as a toe upper portion or a heel lower portion other than the substantially square-shaped, therefore limited, face plate, the carry dramatically decreases.

The present invention has been made to solve the above problems, and accordingly an object thereof is to provide a metallic hollow golf club head in which a face plate is formed by giving consideration to the variations in hit points of general amateur golfers, and the decrease in carry is less for an off-center hit (hit deviating from the sweet spot).

To achieve the above object, the present invention provides a golf club head including a metallic head body having a cavity therein and an opening being formed in a face part therethrough to the cavity, and a metallic face plate welded to the opening, wherein the opening is demarcated by an upper edge along an upper end of the face part and a U shaped curved edge located within the face part, and is also formed so that, in a state in which the head body is soled in accordance with the lie angle, a projection line on the face part surface of the perpendicular passing through the lowermost portion (X) of the opening coincides with a projection line on the face part surface of the perpendicular passing through a ground contact point (Y) of a sole part, or the projection line drawn with the lowermost portion (X) of the opening being the reference is positioned close to a heel part with respect to the projection line drawn with the ground contact point (Y) of the sole part; and the ratio of width on the toe side with respect to the projection line drawn with the ground contact point (Y) of the sole part is higher than the ratio of width on the heel side toward a crown part, and the face plate is formed so as to have a shape matching the opening.

By such a shape of the face plate, the distribution of hit points of general amateur golfers is covered, so that even for an off-center hit, the decrease in carry is less.

DETAILED DESCRIPTION OF THE INVENTION

Preferred embodiments of the present invention will now be described with reference to the accompanying drawings.

Figure 1:
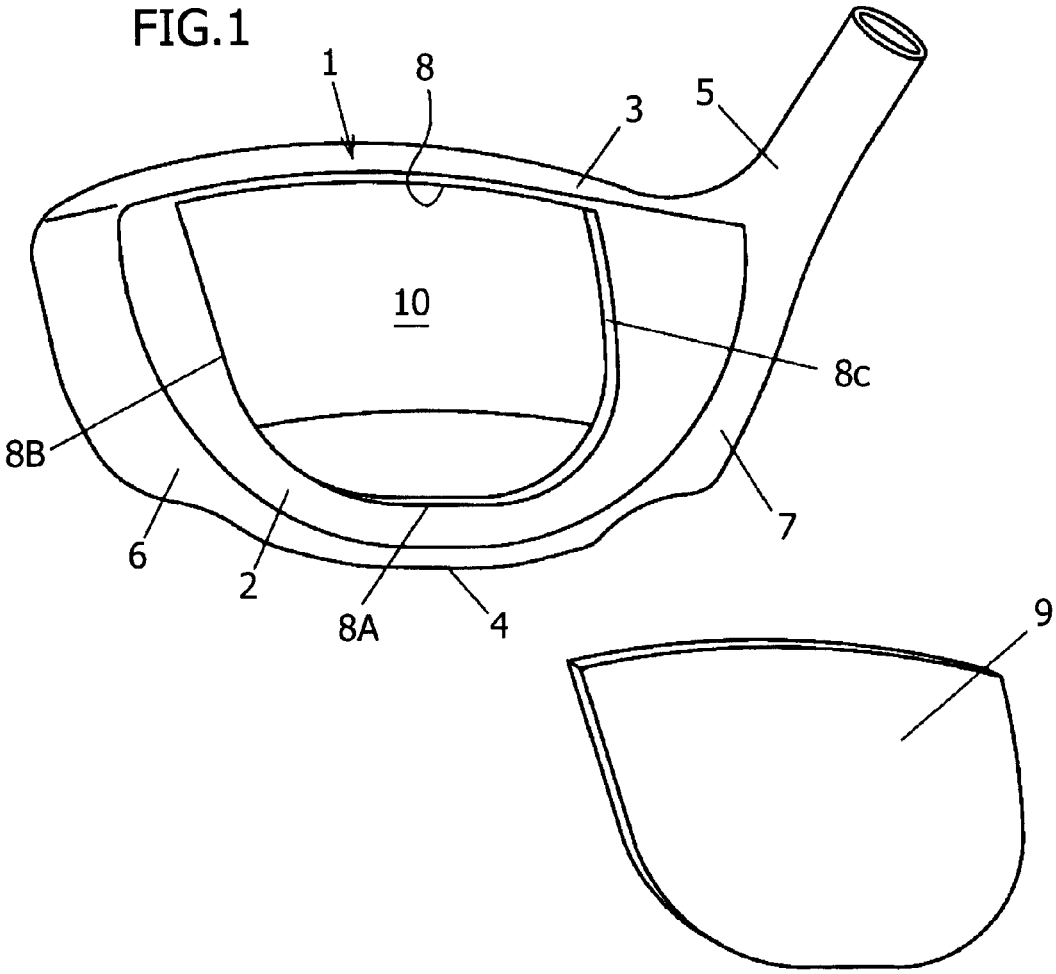
FIG. 1 is a perspective view of a golf club head in accordance with an embodiment of the present invention, showing a state before a face plate is welded.

In FIG. 1, a metallic head body 1 has a cavity 10 therein, and is formed with an opening 8 therethrough to the cavity 10. The head body 1 includes a face part 2, a crown part 3, a sole part 4, and a hosel 5, and has a toe 6 and a heel 7. Unlike the conventional example, the opening 8 does not have a square shape, but is formed into a U shape such that the front shape tilts to the toe 6 side. More specifically, the opening 8 is demarcated by an upper edge along an upper end of the face part 2 and a U shaped curved edge (8B, 8A, 8C) located within the face part 2. A face plate 9 welded to the opening 8 is also formed into a U shape matching the shape of the opening 8.

Figure 2:
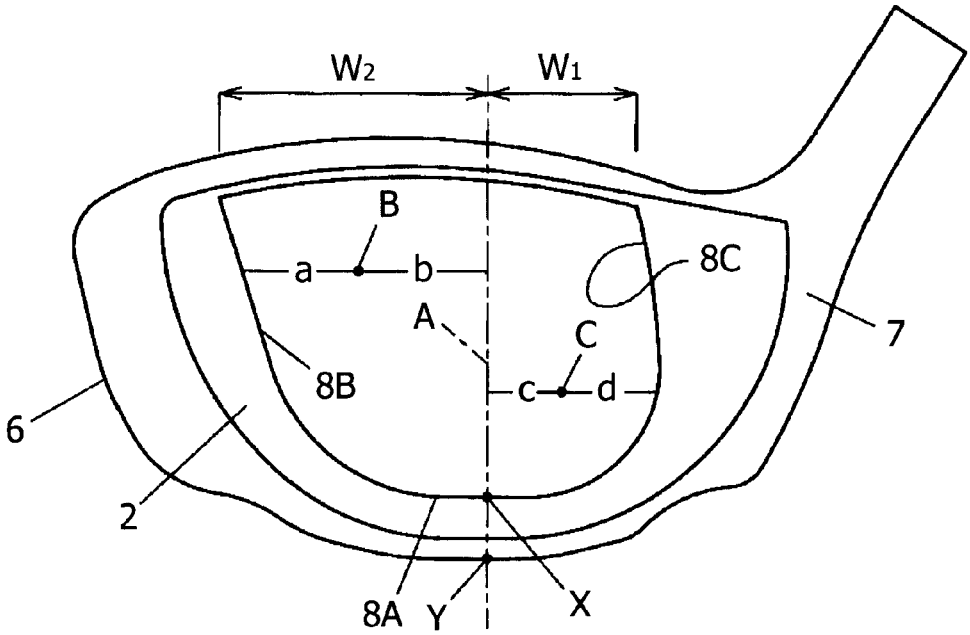
FIG. 2 is a front view showing an opening of the golf club head shown in FIG. 1.

The lowermost portion of a bottom edge 8A of the opening 8 is denoted by symbol X in FIG. 2. A portion between left and right side edges 8B and 8C opposed to each other of the opening 8 is the bottom edge 8A, and the lowermost portion of the bottom edge 8A is a bottom center X. When the head body 1 is soled in accordance with the lie angle, the projection line on the face part 2 surface of the perpendicular passing through a ground contact point Y of the sole part 4 is denoted by symbol A. This projection line A coincides with a projection line drawn with the bottom edge 8A of the opening 8 being the reference. In another preferred embodiment, the projection line (A) drawn with the bottom edge 8A (the bottom center X) being the reference is sometimes positioned close to the heel 7 with respect to the projection line A drawn with the ground contact point Y being the reference. For the opening 8, a width $W_2$ on the toe 6 side is wider, toward the crown part 3, than a width $W_1$ on the heel 7 side with respect to the projection line A passing through the ground contact point Y.

Figure 6:
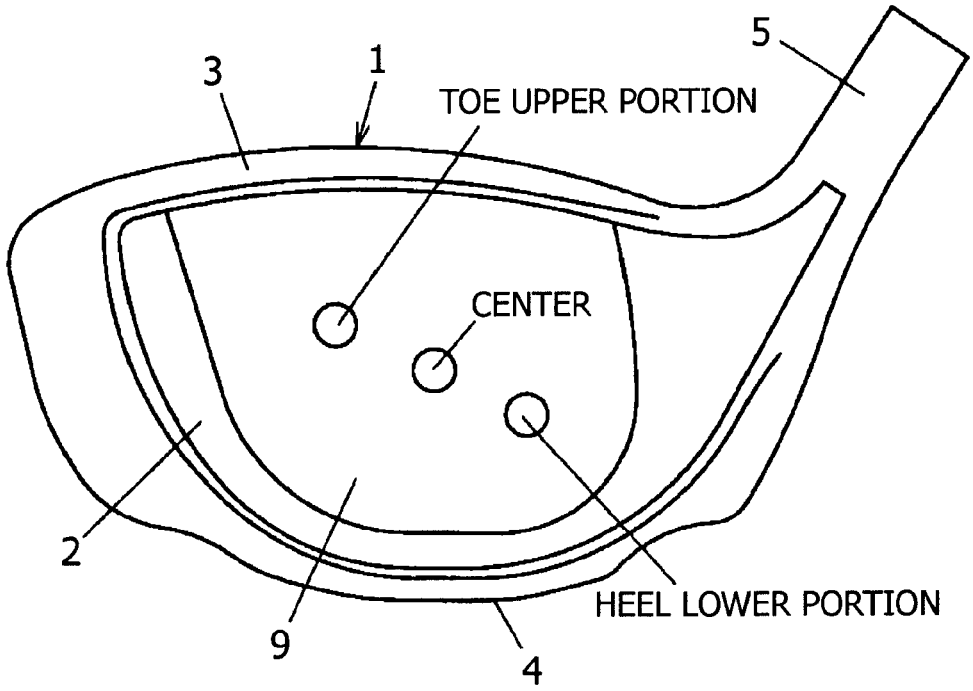
FIG. 6 is a front view showing hit points in a hitting test.

Also, when the center shown in FIG. 6 is positioned on the projection line A, the ratio of the length of the face plate 9 in the horizontal direction to the projection line between a hit point position B close to the upside on the toe 6 side and a hit point position C close to the downside on the heel 7 side is preferably set as described below. For example, for the face plate 9 used for the head having a volume of 400 cc, the ratio (a+b:c+d) between the length from the center on the projection line A to the end close to the toe 6 and the length close to the heel 7 is preferably 53:47, for a head volume of 430 cc, the ratio is preferably 53.9:46.1, and for a head volume of 460 cc, the ratio is preferably 55.6:44.4. In this case, the ratio a:b at the hit point position B is 57:43 for 400 cc, 56.8:43.2 for 430 cc, and 58.9:41.1 for 460 cc. The ratio c:d at the hit point position C is 49:51 for 400 cc, 51:49 for 430 cc, and 52.2:47.8 for 460 cc. Also, in the case where the hit point position B is located 7.5 mm above the center, the ratio a:b is 65:35 to 55:45, and in the case where the hit point position B is located 7.5 mm below the center, the ratio c:d is preferably in the range of 55:45 to 43:57, and the ratio of left and right from the center is preferably in the range of 60:40 to 48:52.

Figure 3:
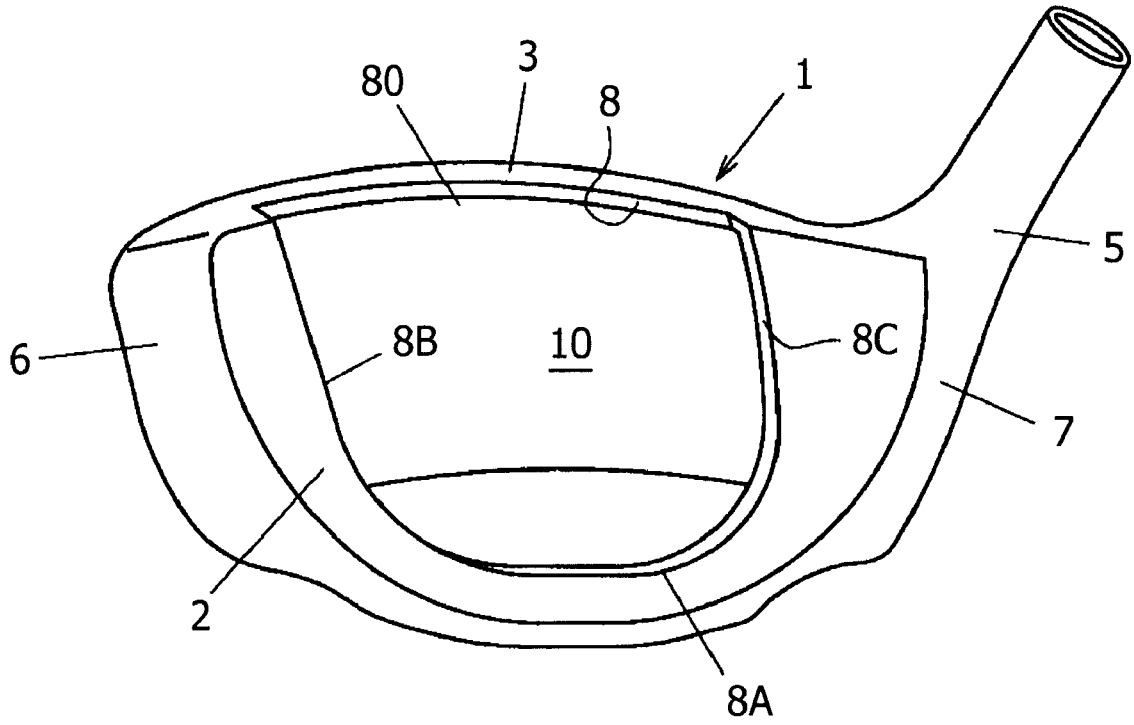
FIG. 3 is a perspective view showing a head body in accordance with another embodiment of the present invention.
Figure 4:
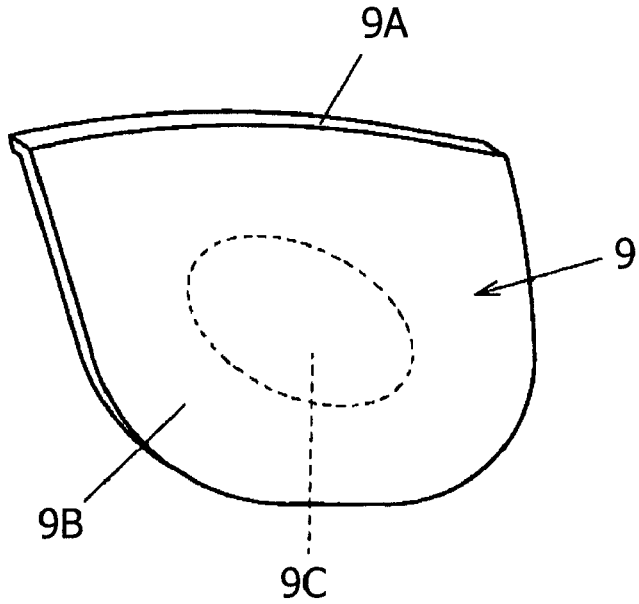
FIG. 4 is a perspective view of a face plate welded to the head body shown in FIG. 3.

In an embodiment shown in FIG. 3, the upper end of the opening 8 is open to a part of the crown part 3 (that portion is denoted by symbol 80), and an extending part 9A extending to a part of the crown part 3 is formed in the upper end portion of the face plate 9 so as to match the shape of such an opening 8 (refer to FIG. 4). The thickness of the extending part 9A is smaller than the thickness of a face surface 9B. Also, on the back surface of the central portion of the face surface 9B of the face plate 9, a thick part 9C is formed in an elliptical region. The major axis of the ellipse corresponding to the thick part 9C tilts so that the height is larger on the toe 6 side and lower on the heel 7 side.

The head body 1 is made of a titanium alloy. The hosel 5, the face part 2, the crown part 3, and the sole part 4 may be formed integrally by forging from a round bar of titanium alloy. Alternatively, the hosel 5 may be manufactured separately by forging, and the face plate 9 may be manufactured by forging or by pressing a rolled material. Since the face surface 9B is a portion for hitting a golf ball, the face plate 9 is preferably made of a forged material or a rolled material having fine crystals. The use of a metallic material for the face plate 9 having a lower Young's modulus than that of the head body 1 is especially preferable because the rebound of ball becomes good. For example, the head body 1 is manufactured by forging using a general titanium alloy of Ti-6A1-4V (Young's modulus: about 110 Gpa). For the face plate 9, a titanium alloy having a Young's modulus lower than 100 Gpa such as Ti-15Mo-3A1 may be used. As the result of experiment conducted by FEM (Finite Element Method) analysis, it was verified that the Young's modulus as low as 70 to 90 Gpa of the face plate 9 increases the initial velocity of ball. Also, after the face plate has been formed by pressing, the thicknesses of the extending part 9A and the periphery of the elliptical thick part 9C of face may be decreased by melting the inside of the head by chemical milling.

Figure 5:
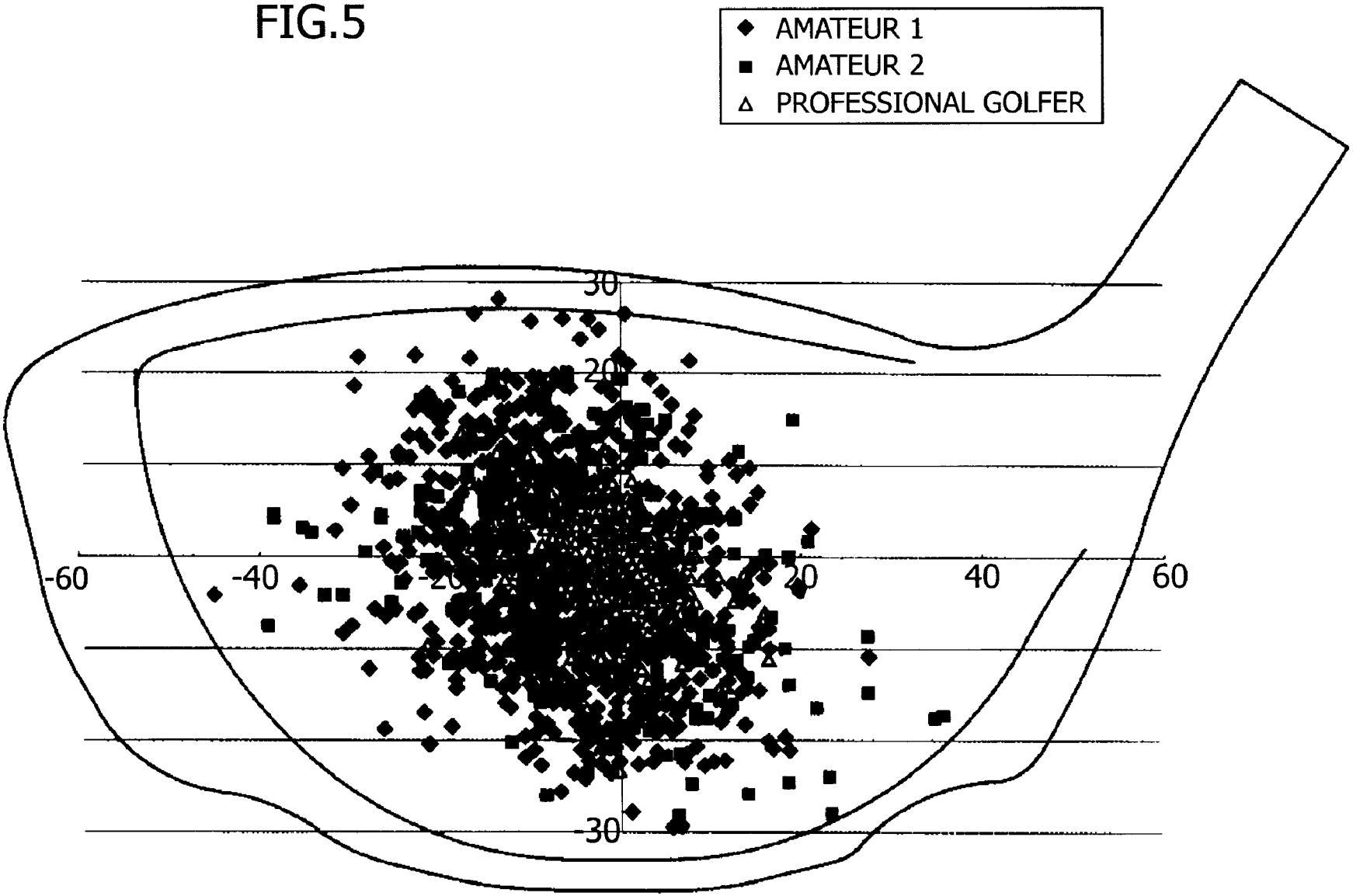
FIG. 5 is a front view showing distribution of hit points of various types of golfers.

The variations in hit points of general amateur golfers were examined using a head having a head volume of 430 cc. As a result, it was found that the golfers tend to hit a ball at the upper portion (the crown part 3 side) on the toe 6 side of the face part 2, and at the lower portion (the sole part 4 side) on the heel 7 side as shown in FIG. 5. Therefore, the extending part 9A in the upper portion on the crown part 3 side is extended so that the location of the crown part 3 is easily deflected, by which the rebound of ball is increased. Thereby, the decrease in carry can be made less even at the time of off-center hit. Also, an effect of increased delivery angle is achieved. The thickness of the extending part 9A should be smaller than that of the face surface 9B. Therefore, the thickness of the extending part 9A extending to the crown part 3 is preferably 0.5 to 3.0 mm, further preferably 0.6 to 1.2 mm. In order to cover 90% or more of the variations in hit points shown in FIG. 5, the face surface 9B requires an area of 2200 $mm^2$ or larger.

The extension width of the extending part 9A of the face plate 9 to the crown part 3 is preferably 5 to 40 mm at a maximum, especially preferably 10 to 30 mm.

The thick part may be formed in the central portion of the face surface 9B, and the elliptical thick part may be provided so that the tilt matches the face surface 9B formed slantwise. The thickness of the thick part 9C is preferably 2.5 to 4.0 mm, especially preferably 2.8 to 3.8 mm. The thickness of the periphery of the thick part 9C is preferably 1.5 to 2.5 mm, especially preferably 2.0 to 2.5 mm.

The angle of the major axis of the ellipse corresponding to the thick part 9C is preferably 3 to 40 degrees (when the lie angle is set at 56 degrees), especially preferably 10 to 30 degrees. The ratio between the major axis length and the minor axis length is preferably 1:0.2 to 1:0.8, especially preferably 1:0.4 to 1:0.6. The tilt is such that the height is larger on the toe side and smaller on the heel side.

It is preferable that in the contact portion of the extending part 9A of the face plate 9 with the opening 8, the thickness of the face plate 9 be equal to or smaller than the thicknesses of the crown part 3 around the opening 8, the side part, and the sole part 4 of the head body 1. In particular, it is preferable that the periphery of a portion having the maximum width of the extending part 9A be thin.

As a manufactured example of the head in accordance with the present invention, the face plate 9 was manufactured by blanking a rolled material of a β-type titanium alloy (Ti-15Mo-3A1) into a U shape and by pressing the blanked material. The face surface 9B is thickest near the face center, being 3.4 mm, and becomes thinner stepwise toward the crown part 3, the side part, and the sole part 4. The thickness of the thinnest peripheral portion is 2.0 mm. The thickness was regulated by acid cleaning (chemical milling). The thick part 9C in the face center portion has an elliptical shape, and the major axis of the ellipse tilts so that the height decreases from the toe 6 side of the crown part 3 to the heel 7 side of the sole part 4. The tilt angle is 20 degrees so as to correspond to the variations in hit points of the general amateur golfers. The elliptical shape of the thick part has a major axis of 18 mm and a minor axis of 9 mm.

The head body 1 was manufactured by an investment casting process using a titanium alloy of Ti-6A1-4V. The opening 8 of the face part 2 is formed so that the projection line drawn with the bottom center X of the U-shaped opening 8 being the reference is positioned on the heel 7 side 2 mm distant from the projection line A with respect to the projection line A drawn with the ground contact point Y of the sole part 4 at the time when the lie angle is set at 56 degrees being the reference. At the center position in the up and down direction of the face part 2, the opening length on the toe 6 side is 35.5 mm, and the opening length on the heel 7 side is 29.4 mm at the center position. Further, at a position 20 mm above vertically, the opening length on the toe 6 side is 41.0 mm, and the opening length on the heel 7 side is 25.6 mm. The face plate 9 manufactured so as to fit the opening 8 was welded, and hit evaluation was performed (refer to FIG. 6). The thickness of the face plate 9 used at this time is uniformly 3.0 mm, and the head volume is 430 cc.

A golf club compared with the golf club head shown in FIG. 6 (comparative example) was manufactured as described below. The head body provided with an opening in the sole part was manufactured by the investment casting process using a titanium alloy of Ti-6A1-4V, the sole part was manufactured by forging in the same way, and the sole part was welded to the head body to manufacture a head having a volume of 430 cc. The thickness of the face is uniformly 2.8 mm.

On the head shown in FIG. 6 and the head of comparative example, the hit point positions were the geometric center on the surface of the face part 2, a toe 6 upper portion (the toe 6 side 15 mm±7.5 mm), and a heel 7 lower portion (the heel 7 side 15 mm±7.5 mm) (refer to FIG. 6). The head speed was 45 m/s. Also, in examples 1 to 3, the Young's modulus of a material forming the face plate 9 was changed.

TABLE 1

| | Young's modulus of material | Hit point position | | |
|---|---|---|---|---|
| | | Toe upper portion | Center | Heel lower portion |
| Comparative example | 110 | 61.2 | 62.9 | 60.9 |
| Example 1 | 110 | 62.3 | 62.9 | 61.2 |
| Example | 90 | 62.8 | 63.4 | 61.9 |
| Example | 70 | 63.8 | 64.1 | 62.5 |
| Unit | (Gpa) | (m/s) | (m/s) | (m/s) |

As given in Table 1, in examples of the present invention (shown in FIG. 6), which use the U-shaped face plate 9, at the time of off-center hit, the initial velocity (m/s) of ball is higher than that in the comparative example. As a result, the decrease in carry for an off-center hit is less.

Figure 7:
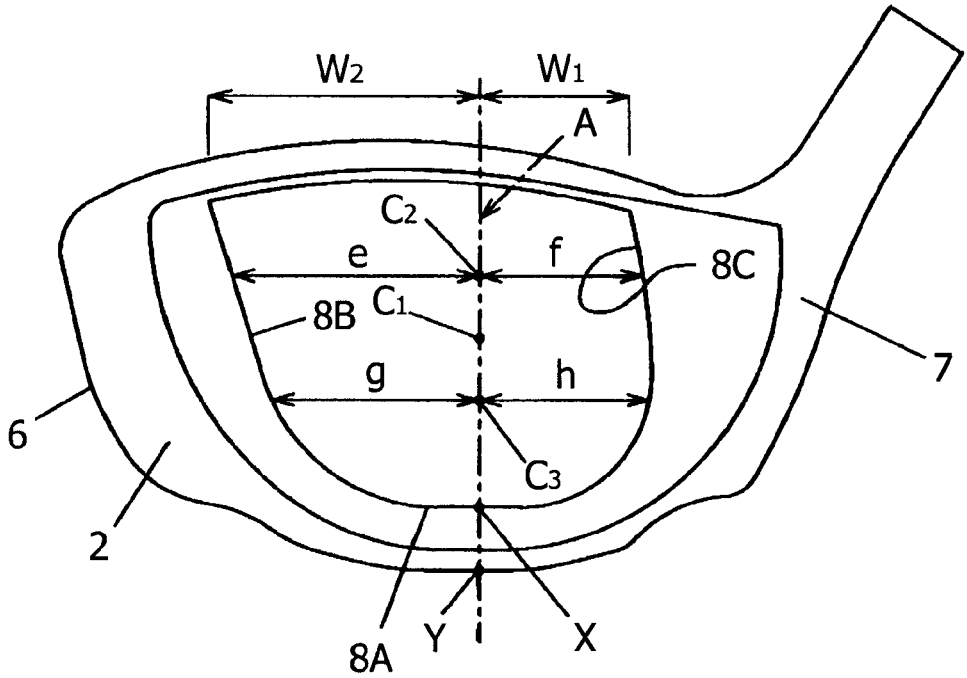
FIG. 7 is a front view showing an opening of the golf club head in accordance with another embodiment of the present invention.
Figure 8:
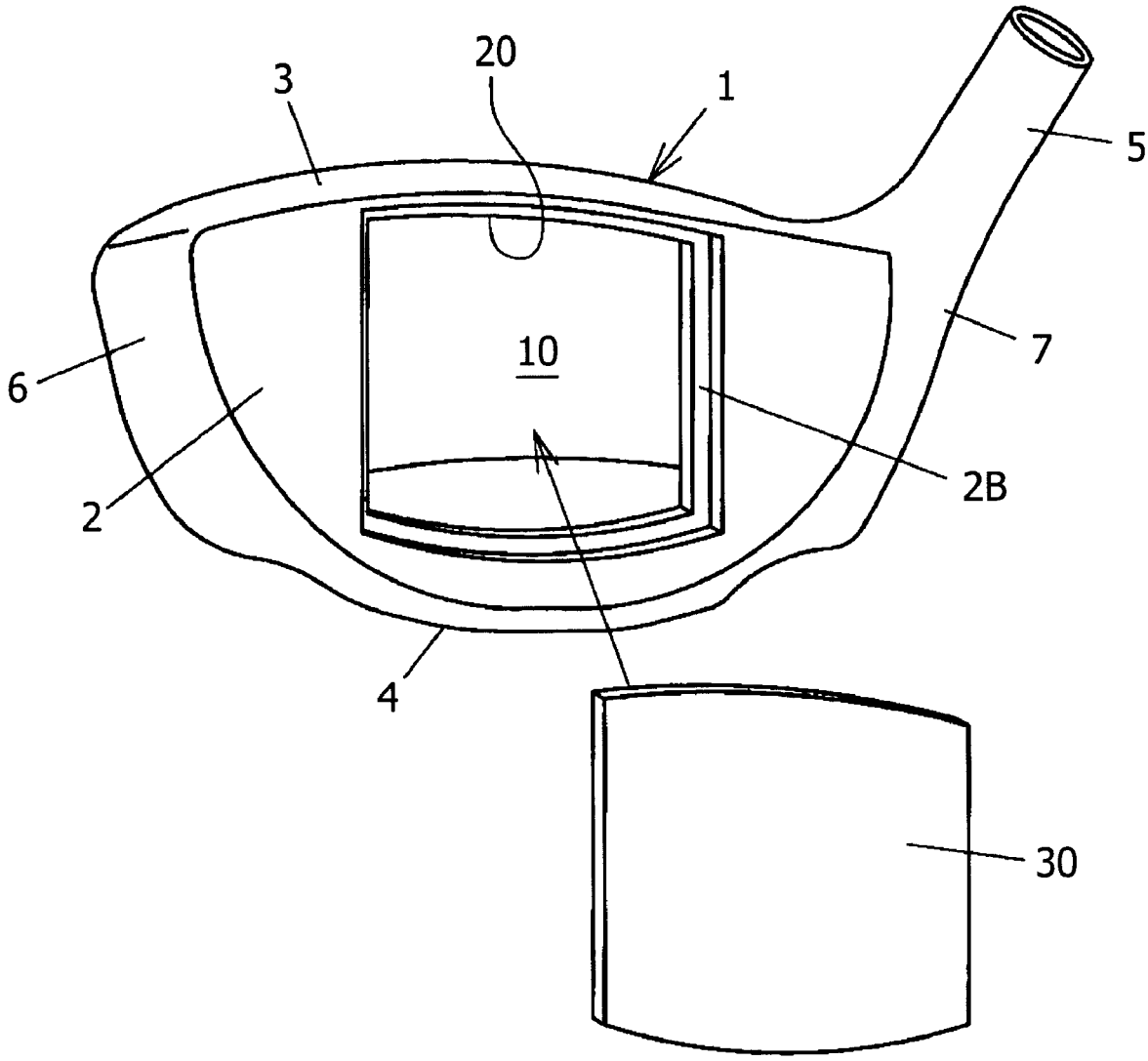
FIG.8(PRIOR ART)
FIG. 8 is a perspective view showing a conventional example.

Furthermore, in another embodiment shown in FIG. 7, in the case where the center of the up and down direction on the projection line A is shown as $C_1$, the position located 7.5 mm above the center $C_1$ is shown as $C_2$, and the position located 7.5 mm below the center $C_1$ is shown as $C_3$, the ratio of the length of the face plate 9 in the horizontal direction from the projection line A to toe side and heel side at each position of $C_1$ to $C_3$ is set as described below. For example, for the head having a volume of 400 cc, the ratio of the horizontal length at the center $C_1$ is preferably 53:47, for a head volume of 430 cc, the ratio is preferably 53.9:46.1, and for a head volume of 460 cc, the ratio is preferably 55.6:44.4. Also, the ratio e:f at the position $C_2$ is preferably in the range of 65:35 to 55:45, the ratio g:h at the position $C_3$ is preferably in the range of 55:45 to 43:57, and at the center $C_1$, the ratio of the length of the face plate 9 in the horizontal direction from the projection line A is preferably in the range of 60:40 to 48:52.

What is claimed is:

1. A golf club head comprising a metallic head body having a cavity therein and an opening being formed in a face part therethrough to the cavity, and a metallic face plate welded to the opening, wherein the opening is demarcated by an upper edge along an upper end of the face part and a U shaped curved edge located within the face part, and is also formed so that, in a state in which the head body is soled in accordance with the lie angle, a projection line on the face part surface of the perpendicular passing through the lowermost portion (X) of the opening coincides with a projection line on the face part surface of the perpendicular passing through a ground contact point (Y) of a sole part, or the projection line drawn with the lowermost portion (X) of the opening being the reference is positioned close to a heel part with respect to the projection line drawn with the ground contact point (Y) of the sole part;

a ratio of a width of the opening on the toe side with respect to the projection line drawn with the ground contact point (Y) of the sole part to a width of the opening on the heel side with respect to the projection line drawn with the ground contact point (Y) of the sole part, is higher at a portion of the opening toward a crown part as compared with a portion of the opening toward the sole part;

the width of the opening on the toe side with respect to the projection line drawn with the ground contact point (Y) of the sole part increases when moving toward the crown part along the projection line, and a point of the opening that is closest to the toe is adjacent to the crown part; and the width of the opening on the heel side with respect to the projection line drawn with the ground contact point (Y) of the sole part decreases when moving toward the crown part along the projection line at the crown part side with respect to a point that is closest to the heel, the point that is closest to the heel being positioned close to the sole part with respect to a center between the crown part and the sole part, and the face plate is formed so as to have a shape matching the opening.

2. The golf club head according to claim 1, wherein the face plate is formed of a material having a Young's modulus lower than that of the head body.

* * * * *